United States Patent [19]

Judkins

[11] Patent Number: 4,518,025

[45] Date of Patent: May 21, 1985

[54] SUN BLIND CONSTRUCTION

[75] Inventor: Ren S. Judkins, Salt Lake City, Utah

[73] Assignee: Verosol USA Inc., Pittsburgh, Pa.

[21] Appl. No.: 550,598

[22] Filed: Nov. 10, 1983

[51] Int. Cl.[3] ..... E06B 3/94

[52] U.S. Cl. ..... 160/84 R; 160/168 A; 160/330; 248/340; 248/264

[58] Field of Search ..... 160/84 R, 168, 38, 39, 160/DIG. 9, 330; 248/264, 270, 269, 340, 323

[56] References Cited

U.S. PATENT DOCUMENTS

| | | | |
|---|---|---|---|
| 938,088 | 10/1909 | Sullivan | 248/269 |
| 1,959,137 | 5/1934 | Miller | 160/84 R |
| 3,646,986 | 3/1972 | Anderle | 160/168 |
| 4,254,813 | 3/1981 | Vecchiarelli | 160/38 |

FOREIGN PATENT DOCUMENTS

| | | | |
|---|---|---|---|
| 466409 | 5/1937 | United Kingdom | 160/330 |

*Primary Examiner*—Peter M. Caun

*Assistant Examiner*—Cherney S. Lieberman

*Attorney, Agent, or Firm*—Kenyon & Kenyon

[57] ABSTRACT

A sun blind for window openings having at least one of the upper and lower edges disposed, at least in part, at other than the horizontal, is disclosed. In one embodiment, the upper edge of the window opening is disposed at other than the horizontal, for example, at a slant, and the sun blind includes an upper rail conforming to the outline of the upper edge of the window opening and a rod fastened to the upper rail spaced apart from the upper rail. The rod is threaded through spaced apertures in the sun blinding member and retains the sun blinding member and a lower rail attached to it. The rod is clamped to the upper rail by fastening clips slidably disposed in the upper rail. Suitable cords are arranged for moving and guiding the sun blinding member. The sun blind can be used in window openings having slanted, peaked and arch-shaped upper or lower edges, for example.

18 Claims, 7 Drawing Figures

SUN BLIND CONSTRUCTION

BACKGROUND OF THE INVENTION

The present invention relates to sun blinds and more particularly to sun blinds wherein at least one edge of the opening to be covered is disposed, at least in part, at other than the horizontal, for example, a sun blind where the upper edge is disposed at an angle to the horizontal, i.e., slanted. The present sun blind also may be applied to openings having upper edges of any shape, such as those which are peaked or arched in design and in openings having lower edges of any shape, including horizontal, slanted or arch shaped, for example.

A known method for disposing sun blinds in window openings having at least one edge which is disposed at other than the horizontal, e.g., a slanted upper edge, includes the use of staples to fasten the sun blinding member to the upper rail of the sun blind, the upper rail being located adjacent the upper edge. The known method, however, has several disadvantages, including the difficulty and inconvenience of installation and the unattractive and "bunched" appearance of the pleats in pleated type sun blinds which results in the area near the staples due to the "flattening" of the pleats when installed on the upper rail.

SUMMARY OF THE INVENTION

It is an object of the present invention to provide a sun blind for window openings which have at least one edge disposed, at least in part, at other than the horizontal and which solves the disadvantages of the known methods.

It is therefore an object of the present invention to provide a sun blind for window openings which have either or both the upper and lower edges disposed at an angle to the horizontal.

It is a further object of the present invention to provide a sun blind which can be disposed in window openings which are peaked or arch-shaped in design.

It is a still further object to provide a sun blind for window openings of the aforementioned types which provides a uniform, attractive appearance.

It is also an object of the present invention to provide a sun blind structure which can be conveniently installed in window openings of the aforementioned types.

It is furthermore an object of the present invention to provide a sun blind which can be disposed in window openings having varying shaped upper and lower edges, for example, edges which are curved.

These and other objects of the present invention are achieved by a sun blind operable between an open and a closed position for an opening having upper and lower edges, at least one of the edges being disposed, at least in part, at other than the horizontal, comprising:

first rail means disposed adjacent the upper edge of the opening conforming to the outline of the upper edge;

second moving rail means disposed adjacent the lower edge of the opening when the sun blind is in the closed position conforming to the outline of the lower edge;

a sun blinding member disposed between the first and second rail means, the sun blinding member conforming to the outline of the edge disposed at other than the horizontal and having a plurality of spaced openings disposed substantially adjacent the edge;

means conforming to the outline of the edge disposed at other than the horizontal, the means disposed through the plurality of spaced openings for retaining the sun blinding member;

means for attaching the retaining means to the rail means disposed adjacent the edge disposed at other than the horizontal; and means for moving the second rail means to raise and lower the sun blinding member.

In a preferred embodiment of the sun blind, the retaining means comprises rod means and the attaching means comprises fastening clip means slidably disposed in the rail means disposed adjacent the edge disposed at other than the horizontal and having clamping means for clamping the rod means.

Other objects, features and advantages of the present invention will be apparent from the detailed description below.

BRIEF DESCRIPTION OF THE DRAWINGS

The sun blind according to the present invention will be described in greater detail in the following detailed description with reference to the drawings in which.

DETAILED DESCRIPTION

Figure 1:
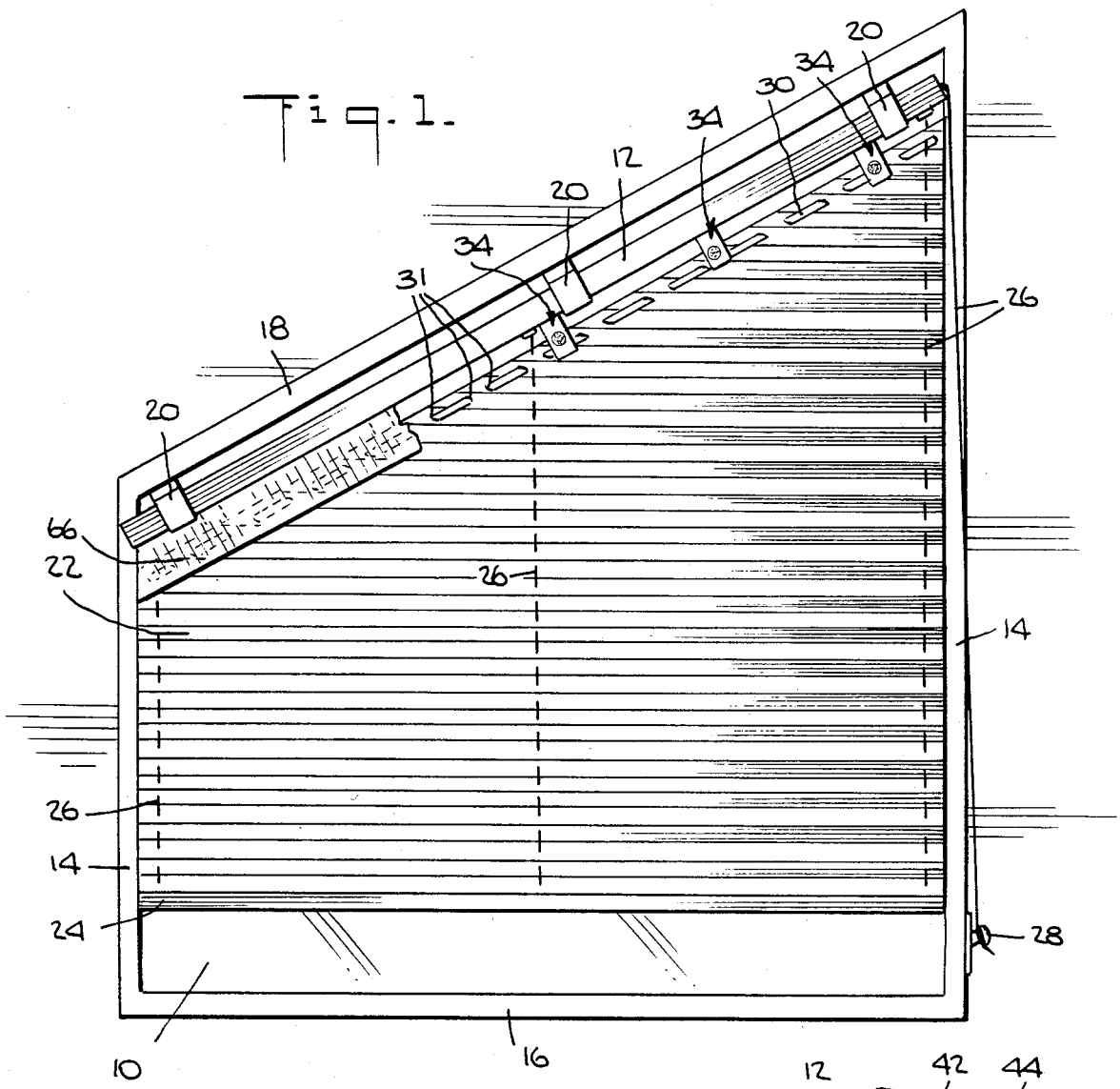
FIG. 1 is a front view of one embodiment of the sun blind according to the present invention disposed in a window opening having a slanted upper edge.

With reference now to the drawings, FIG. 1 is a front view of a sun blind according to the present invention disposed in a window opening having at least one edge disposed at other than the horizontal, for example, a slanted or inclined upper edge as illustrated, also known in the trade as a "slant" opening. As shown, it is disposed at an angle from the horizontal. The sun blind according to the present invention can also be used in "peaked" window openings, in which case the mirror image of the sun blind shown might appear to the right of FIG. 1. Of course, the peaked opening need not be symmetrical, and the downwardly sloping section which would appear to the right of FIG. 1 could have a different slope or length, for example. Additionally, the sun blind disclosed herein can be disposed in other window openings which have either or both upper and lower edges disposed, at least in part, at other than the horizontal. For example, the sun blind disclosed herein could be used in window openings which are arch-shaped along either or both their lower or upper edges. Furthermore, the blind of the present invention can also be applied to openings disposed along inclined surfaces, such as the skylights of building roofs, if appropriate guiding means are used for guiding and supporting the sun blinding member.

FIG. 1 shows a "slant" window opening 10, as described, framed by vertical edges 14, lower edge 16 and upper slanted edge 18. The lower edge 16 is shown as horizontally disposed but it need not be. For example, the lower edge could have the same contour as the upper edge, or it could have some other configuration. A head rail or upper rail 12 is disposed adjacent the upper edge 18. Fastening means, such as spring clips 20, shown in more detail in FIGS. 2 and 3, securely hold the upper rail to the slanted upper edge 18. The clips may be mounted to the upper edge by screws 21. A sun blinding member 22, shown as a pleated member, is disposed between the upper rail 12 and a moving, or lower rail 24. The lower rail is shown as horizontally disposed but it could also have the same contour as the upper rail, or could have a shape of some other configuration, depending on the shape of the lower edge 16 of the window opening. If the lower rail is not disposed horizontally, then the same fastening means illustratively disclosed herein for attaching the sun blinding member to the upper rail may also be used to attach it to the lower rail. If the lower rail is disposed horizontally, then the sun blinding member 22 may be attached to it in a known manner, such as by staples, for example. A cord structure 26 is used to move the sun blinding member and lower rail vertically, likewise in a known manner, when it is desired to raise or lower the blind. Additional cords could also be used to guide and support the sun blinding member, particularly in applications where the sun blind is disposed in an inclined surface, such as, for example, in roof skylights. As shown, the individual cords of the cord structure 26 may be tied to a post 28 disposed along the window edge for securing the blind, travel up to the upper rail 12 and then individually through the rail 12, exiting at evenly spaced intervals along the upper rail 12 and extending downwardly through a series of aligned openings in the sun blinding member 22 to the lower rail 24, where they are securely tied off. Instead of a pleated sun blinding member, slatted or flat members could alternatively be used. Furthermore, instead of post 28, a cord locking device could be disposed at one end of the upper rail 12 to securely lock the cords 26.

The sun blinding member 22 is cut so as to conform to the edge disposed at other than the horizontal, i.e. the upper edge 18 of the illustrated window opening, and includes a series of openings 31 disposed adjacent the upper rail 12 through which a rod or wire 30 is threaded. The rod 30 may be of rigid material, or for other applications wherein the upper edge of the window opening is not linear, may be of an easily conformable material such as deformable wire. Rod 30 is movably secured to upper rail 12 by fastening clips 34, to be described in more detail below.

As shown in the drawings, upper rail 12 may be a generally two part, interlocking hollow structure including outer channel member 36 having lips 38 and inner channel member 40 slidable therein. Channels 36 and 40 may be made of extruded aluminum or plastic, for example. Alternatively, the upper rail 12 may be one integral piece. It should be made hollow so that cords 26 for raising and lowering the sun blind can be routed therethrough. A decorative end cap 42 is disposed at each end, one end having a duct 44 for the cords 26. Additionally, a cord locking device could be made integrally with the end cap 42 so as to lock the sun blind in a fixed position. Furthermore, lower rail 24 may also be made in the same manner as upper rail 12.

Figure 7:
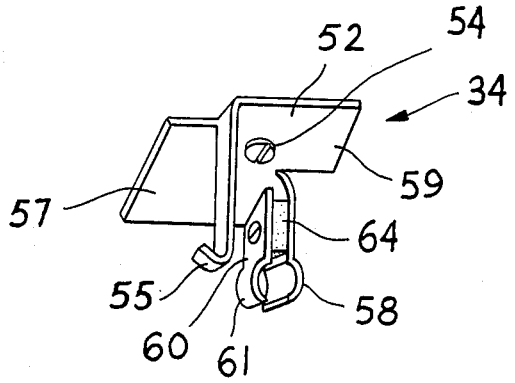
FIG. 7 is a perspective view of an alternative embodiment of the fastening clip structure.

Fastening clips 34 for securing the rod 30 to the upper rail are disposed at evenly spaced intervals, as shown in FIG. 1. Clips 34 serve the dual purpose of securing the rod 30 to the upper rail 12 and, if a pleated sun blinding member 22 is used, of insuring that the pleats in the sun blinding member 22 do not move down the rod 30, thus maintaining a uniform appearance of the pleats. Clips 34 may comprise a plate member 50 and a bracket 52, which may be L-shaped or generally U-shaped as shown. Bracket 52 may be attached to plate member 50, as shown, by spot welds 55. Other fastening means could alternatively be used or, as shown in FIG. 7, bracket 52 and plate member 50 could be made as one integral piece. Plate member 50 is slidably secured into notches 56 formed between channel member 40 and the lips 38 of channel member 36. Screw 54 is threaded into clip 34 and securely clamps clip 34 to the upper rail 12 when it is biased against the channel member 40. To adjust the position of clip 34, screw 54 need only be loosened, the clip slidably moved in the notches 56 to its new position and the screw retightened. Alternatively, channel 40 could include a series of apertures and clip 34 could include snap fastening means which engage the apertures. Other suitable fastening or clamping means could also be used. In the alternative embodiment shown in FIG. 7, clip 34 is made so that plate member 50 and bracket 52 are one piece, in which case bracket 52 may have extensions 57 and 59 on either side which slidably engage with notches 56. In the embodiment of FIG. 7, bracket 52 may be made of one piece of pressed or formed sheet metal material.

Bracket 52 has a curved bead 58 at the end of leg 51 thereof which conforms to rod 30. A clamping plate member 60 is fastened to bracket 52 by a screw 62 threaded into leg 51 of bracket 52. A spring or block of resilient material such as a rubber washer 64 is disposed between the plate 60 and the bracket 52. The force exerted by this resilient member makes it more convenient to attach the rod 30 disposed through the sun blinding member 22 to the clips 34, since the screws 62 can be lightly tightened and the rod 30 then snapped into the area between the bead 58 and the plate 60 without immediately falling out. All the installer then need do is tighten the screws 62 to insure secure fastening of the rod 30 to the clips 34 to prevent rod 30 from sliding relative to the clip. Additionally, resilient member 64 also serves as a locking device for the screw 62 once the screw is tightened.

Figure 2:
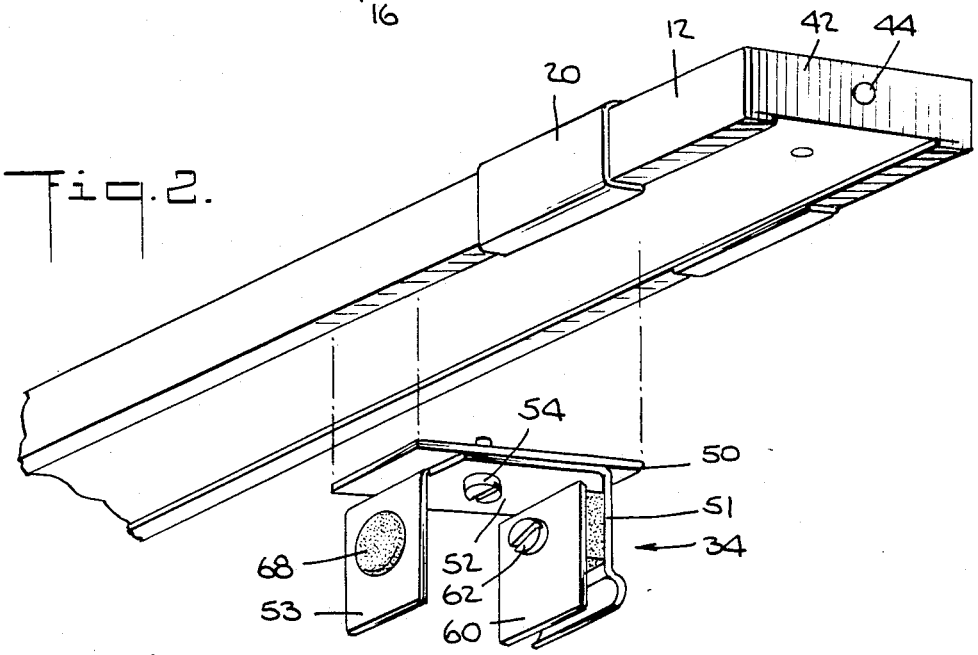
FIG. 2 is an exploded perspective view of the upper rail of the sun blind of FIG. 1 also illustrating one embodiment of the fastening clip structure which fastens a rod to which the sun blinding member attaches to the upper rail.
Figure 3:
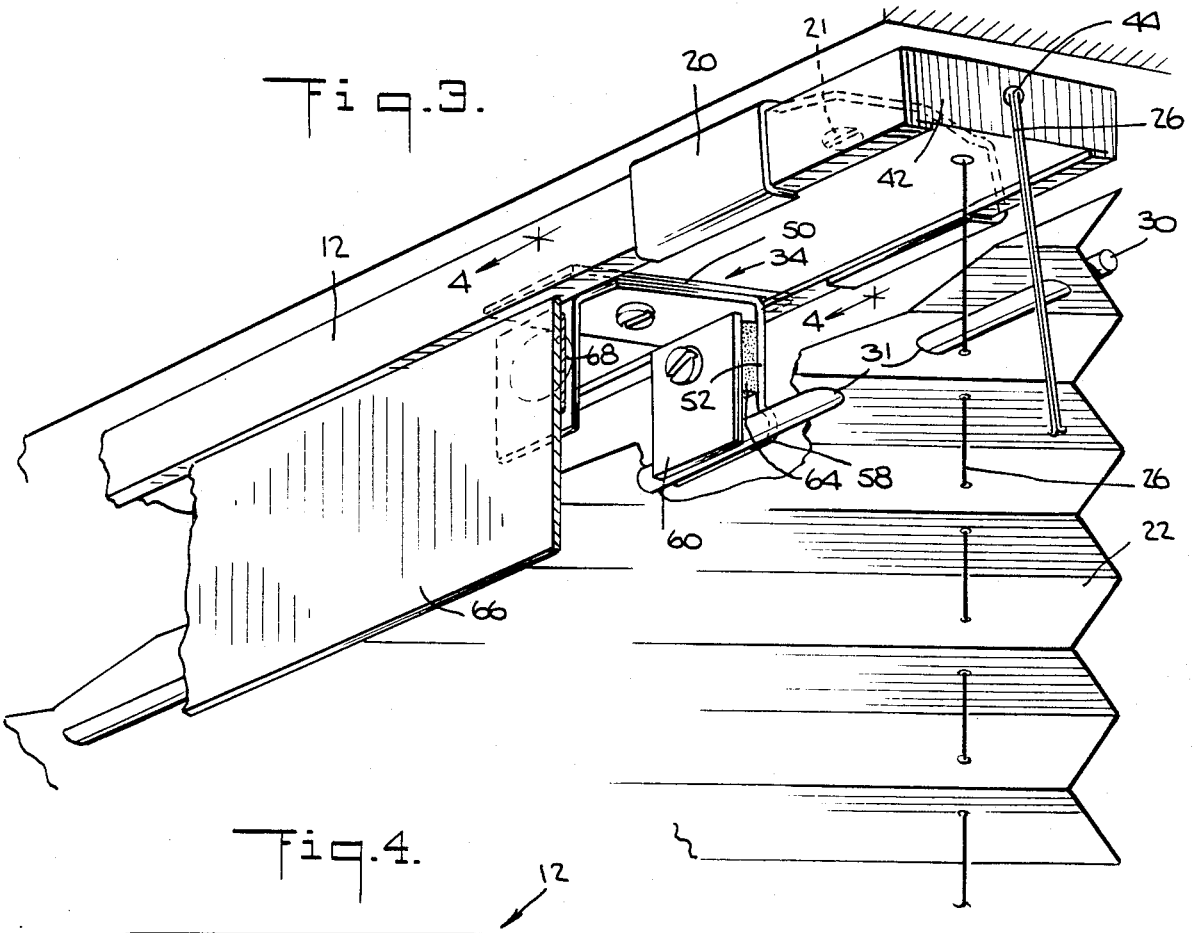
FIG. 3 is a perspective view of the upper rail of FIG. 2 showing the fastening clip structure and attaching rod in greater detail and also illustrating other features of the invention.
Figure 4:
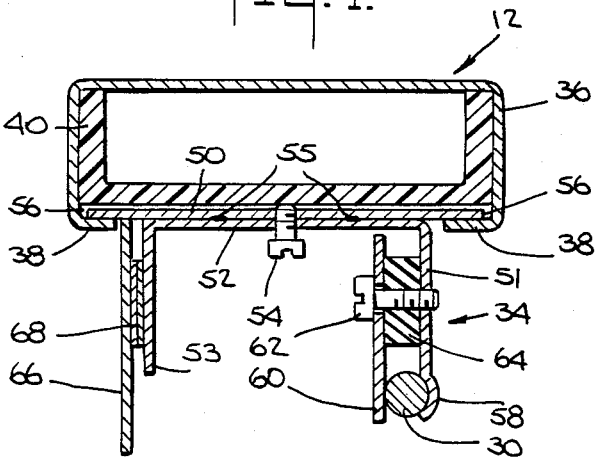
FIG. 4 is a cross sectional side view of the upper rail shown in FIG. 3 taken along the line 4—4 in FIG. 3.
Figure 5:
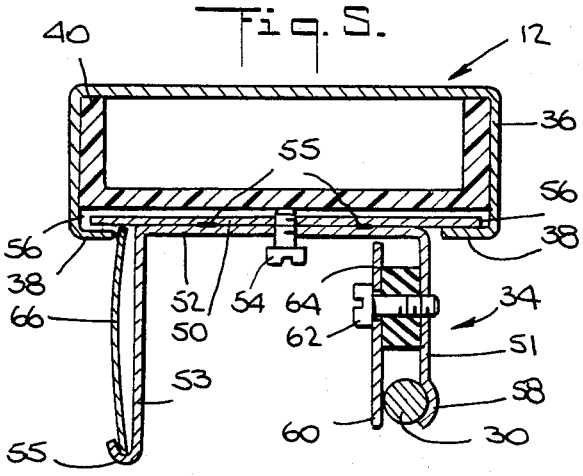
FIG. 5 is another cross sectional view of the upper rail shown in FIG. 3 but showing an alternate embodiment of an ornamental valance.

Although generally plate 60 and leg 51 of bracket 52 will be disposed behind the pleated member 22, for the sake of appearance, a valance 66 may be provided. Valance 66 can be secured to a leg 53 of bracket 52 by fastener 68 such as a snap fastener or a "hook and loop" fastener material such as Velcro, as shown in FIGS. 2, 3 and 4. As shown, valance 66 extends the entire length of the upper rail 12. In an alternative embodiment, as shown in FIG. 5, leg 53 of bracket 52 has a lip 55 which securely grasps valance 66 once it is snapped between plate member 50 and the lip 55. Valance 66 may be made of thin rolled spring metal such as is conventionally used in slatted type window blinds. Alternatively, a plastic or metal extrusion could also be used.

Figure 6:
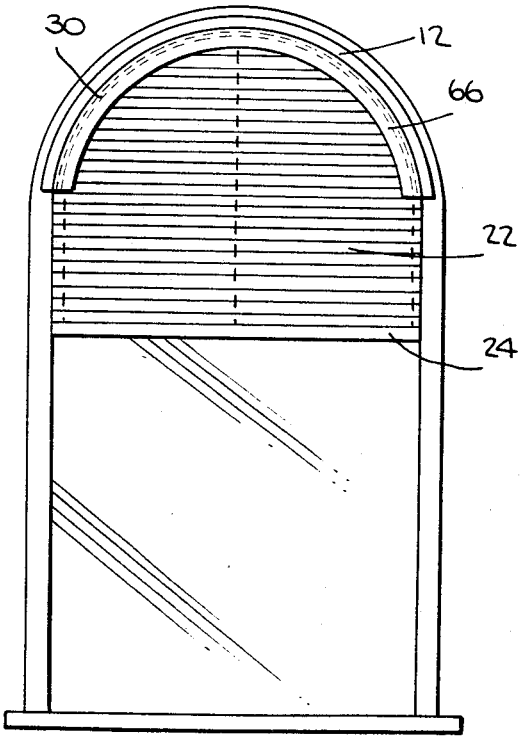
FIG. 6 is a front view of the application of the sun blind of the present invention to an arch-shaped window opening.

FIG. 6 illustrates how the sun blind according to the present invention can be applied to window openings having an arch-shaped upper edge. As shown, upper rail 12, rod 30 and valance 66 must be made so as to conform to the curved contour of the upper edge of the window opening. Rod 30 can be made of a deformable material such as metal wire.

FIG. 7 illustrates an alternative embodiment of fastening clip 34. In this embodiment, the separate plate member 50 of the embodiment of FIG. 2 is dispensed with and bracket 52 includes two extensions 57 and 59 which are slidable in notches 56 of upper rail 12. Additionally, this embodiment shows clamping plate member 60 also provided with a bead 61 for conforming to rod 30. Of course, clamping plate member 60 of either illustrated embodiment or of other alternative embodiments could have this feature.

There has thus been described in detail the design and construction of a sun blind for window openings having varying shape upper and lower edges. The sun blind provides a novel means for attractively fastening sun blinding members to such window openings. In particular, the disclosed structure allows, among other things, slidable adjustment of the fastening clips 34 and thus the sun blinding member relative to the upper rail 12 and rod 30 and convenience of installation. Furthermore, the disclosed structure provides a convenient means for supporting the sun blinding member and for fixing its position once the desired position has been attained.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. A sun blind operable between an open and a closed position for an opening having upper and lower edges, at least one of said edges being disposed, at least in part, at other than the horizontal, comprising:

first rail means disposed adjacent said upper edge of said opening conforming to the outline of said upper edge;

second moving rail means disposed adjacent the lower edge of the opening when the sun blind is in the closed position conforming to the outline of the lower edge;

a sun blinding member disposed between said first and second rail means, said sun blinding member conforming to the outline of said edge disposed at other than the horizontal and having a plurality of spaced openings disposed substantially adjacent said edge;

means conforming to the outline of the edge disposed at other than the horizontal, said means disposed through said plurality of spaced openings for retaining said sun blinding member;

means for attaching said retaining means to said rail means disposed adjacent the edge disposed at other than the horizontal; and means for moving said second rail means to raise and lower said sun blinding member.

2. The sun blind recited in claim 1 wherein said retaining means comprises rod means.

3. The sun blind recited in claim 2 wherein said attaching means comprises fastening clip means disposed on said rail means disposed adjacent the edge disposed at other than the horizontal and means for securing said fastening clip means to said rail means, said fastening clip means including means for clamping said rod means to said fastening clip means.

4. The sun blind recited in claim 3 wherein said fastening clip means is slidably disposed in a notch in said rail means disposed adjacent the edge disposed at other than the horizontal, said fastening clip means including a depending leg extending therefrom in the direction of said sun blinding member and said clamping means comprises plate means spaced apart from said depending leg and means for fastening said plate means to said depending leg to clamp said rod means between said plate means and said depending leg.

5. The sun blind recited in claim 4 wherein at least one of said depending leg or said plate means includes a bead conforming at least partly to the cross section of said rod means and said fastening means comprises screw means.

6. The sun blind recited in claim 5 wherein said fastening means further comprises resilient biasing means disposed between said plate means and said depending leg.

7. The sun blind recited in claim 6 wherein said resilient biasing means comprises a resilient washer disposed around said screw means.

8. The sun blind recited in claim 3 wherein said securing means comprises screw means threaded into said fastening clip means biased against said rail means disposed adjacent the edge disposed at other than the horizontal.

9. The sun blind recited in claim 4, further comprising valance means located adjacent said rail means disposed adjacent said edge disposed at other than the horizontal and in front of said fastening clip means.

10. The sun blind recited in claim 9, wherein said fastening clip means further comprises a second depending leg extending therefrom in the direction of said sun blinding member and further comprising means for fastening said valance means thereto.

11. The sun blind recited in claim 10 wherein said means for fastening said valance means comprises lip means extending from said second depending leg, said valance means located between said rail means disposed adjacent the edge disposed at other than the horizontal and said lip means.

12. The sun blind recited in claim 3 wherein said moving means comprises cord means and said sun blinding member comprises a pleated sun blinding member.

13. The sun blind recited in claim 1 wherein said edge disposed at other than the horizontal is at least partly linear and disposed at an angle to the horizontal.

14. The sun blind recited in claim 1 wherein said edge disposed at other than the horizontal is at least partly curved.

15. The sun blind recited in claim 4 wherein said rail means disposed adjacent the edge disposed at other than the horizontal comprises first and second interlocking channel member means, said second channel member means slidably disposed in said first channel member means and inverted therefrom, said first channel member means having a depending lip extending therefrom, said notch being formed between said lip and said second channel member means and said securing means comprises screw means threaded into said fastening clip means biased against said second channel member means.

16. The sun blind recited in claim 4 wherein said fastening clip means comprises second plate means slidably disposed in said notch of said rail means disposed adjacent the edge disposed at other than the horizontal and bracket means fastened to said second plate means, said depending leg extending from said bracket means.

17. The sun blind recited in claim 16 wherein said bracket means is a substantially L-shaped member, said depending leg forming one leg of said L-shaped member, the other leg of said L-shaped member being attached coplanarly to said second plate means.

18. The sun blind recited in claim 17 wherein said bracket means includes a second depending leg so as to form a substantially U-shaped member, said second depending leg including additional fastening means disposed thereon and valance means connected to said second depending leg by said additional fastening means so as to cover said bracket means.

* * * * *